US008783465B2

(12) United States Patent
Ungerechts et al.

(10) Patent No.: US 8,783,465 B2
(45) Date of Patent: Jul. 22, 2014

(54) MOBILE CLASSIFIER

(75) Inventors: Herbert Ungerechts, Kerken (DE); Hans-Joerg Frank, Toenisvorst (DE); Dieter Scholten, Alsdorf (DE); Juergen Janssen, Geldern (DE); Markus Hagedorn, Muelheim/Ruhr (DE)

(73) Assignee: Bayer MaterialScience AG (DE)

( * ) Notice: Subject to any disclaimer, the term of this patent is extended or adjusted under 35 U.S.C. 154(b) by 136 days.

(21) Appl. No.: 13/430,130

(22) Filed: Mar. 26, 2012

(65) Prior Publication Data

US 2012/0248012 A1 Oct. 4, 2012

(30) Foreign Application Priority Data

Mar. 30, 2011 (EP) ..... 11160512

(51) Int. Cl.
*B07B 7/00* (2006.01)

(52) U.S. Cl.
USPC ..... 209/137; 209/935

(58) Field of Classification Search
USPC ..... 209/133–154, 710–723, 935; 406/38, 406/39, 41, 108, 113; 55/356
See application file for complete search history.

(56) References Cited

U.S. PATENT DOCUMENTS

| | | | | |
|---|---|---|---|---|
| 3,842,461 | A * | 10/1974 | Wurster | 15/326 |
| 5,035,331 | A | 7/1991 | Paulson | |
| 5,749,470 | A * | 5/1998 | Operschall et al. | 209/2 |
| 6,595,369 | B2 | 7/2003 | Paulson | |
| 7,278,804 | B2 * | 10/2007 | Deal et al. | 406/197 |
| 7,380,670 | B2 | 6/2008 | Paulson et al. | |
| 7,621,975 | B2 | 11/2009 | Schneider et al. | |
| 8,377,160 | B2 * | 2/2013 | Witter | 55/337 |
| 2011/0067569 | A1 * | 3/2011 | Valerio et al. | 95/268 |
| 2012/0247915 | A1 * | 10/2012 | Ungerechts et al. | 193/15 |
| 2012/0251246 | A1 * | 10/2012 | Ungerechts et al. | 406/34 |
| 2012/0251247 | A1 * | 10/2012 | Ungerechts et al. | 406/34 |
| 2013/0292304 | A1 * | 11/2013 | Plant et al. | 209/139.1 |
| 2014/0021109 | A1 * | 1/2014 | Kozawa et al. | 209/710 |

* cited by examiner

*Primary Examiner* — Jeremy R Severson
(74) *Attorney, Agent, or Firm* — Drinker Biddle & Reath LLP

(57) ABSTRACT

A mobile classifier (deduster) has docking devices, flushing devices and control for the dedusting of granules, in particular polymer granules, with preference polycarbonate granules. The mobile classifier can be set up at different locations underneath silos. To perform its function, the mobile classifier is technically connected to stationary pipelines, filters and fans.

13 Claims, 1 Drawing Sheet

MOBILE CLASSIFIER

PRIORITY

Priority is claimed to European Patent Application No. 11 160 512.7, filed Mar. 30, 2011, the disclosure of which is incorporated herein by reference in its entirety

BACKGROUND OF THE INVENTION

1. Field of the Invention

The field of the present invention relates to a mobile classifier (deduster) with docking devices, flushing devices and control for the dedusting of granules, in particular polymer granules, with preference polycarbonate granules. Such a mobile classifier can be set up at different locations underneath silos. To perform its function, the mobile classifier is technically connected to stationary pipelines, filters and fans.

2. Background

The granular product occurring in the reactor during the production of thermoplastics is plasticated in an extruder and formed into individual strands, which are cut into granules by means of a knife rotating in the granulating die. The granulation may be performed, for example, in a stream of liquid. Subsequently, the granules are dried and screened, in order to separate out agglomerates formed in spite of cooling. After that, the product is pneumatically conveyed to a mixing silo, from which the product is then filled and packaged. On account of the silo design and the filling strategy, mixing (homogenization) of the product inevitably takes place when it is removed from the mixing silo.

In order to separate out abraded material in dust form and further materials in dust form that are formed during the pneumatic conveyance or during mixing, depending on the proportion of dust, the granules are subjected prior to the filling or packaging process to a dedusting operation performed by air classification by means of a classifier (deduster).

Classifiers are known per se and are described, for example, in U.S. Pat. No. 5,035,331, U.S. Pat. No. 6,595,369, U.S. Pat. No. 7,380,670 and U.S. Pat. No. 7,621,975. However, these disclosures are merely concerned with increasing the efficiency of stationary classifiers (better dedusting) and ignore the handling of the classifier itself, and possibly the suitability thereof for being washed down to avoid contamination by dust and granules from an earlier dedusting operation involving different granules, which contaminate the present product during the dedusting in the classifier.

SUMMARY OF THE INVENTION

The problem addressed here has been solved by providing a device, comprising a classifier with an integrated working platform, possibly a fully automatic control and a stationary part of the plant substantially comprising pipelines and filter and fan systems, which includes a base frame with an integrated working platform provided with a travelling mechanism, in order to accommodate all the required components for a working dedusting process, in order thereby to set up a classification efficiently at different silo locations. The travelling frame accommodates several dedusting components.

BRIEF DESCRIPTION OF THE DRAWINGS

In the drawings, wherein like reference numerals refer to similar components.

DETAILED DESCRIPTION OF THE PREFERRED EMBODIMENTS

On the basis of the prior art, there was the problem of providing a classifier with the aid of which granules can be dedusted, the classifier not being stationarily located in one place, but able to be used mobily in a plant for different operations. At the same time, the device should be designed in such a way that ergonomic docking of the device onto the silo outlets is possible. A further goal is to make the procedure for operating the device such that the setting of the individual operating parameters on the basis of the numerous different classifier locations is performed in a reliable and user-friendly manner.

A further problem addressed is that of providing a classifier which, after completion of the dedusting process, is largely free from residual amounts of the granules previously conveyed therein and can be cleaned easily and reliably of any remains of granules possibly still present in the classifier by flushing, for example with water and/or compressed air, so that contamination with following portions of granules can be ruled out with certainty.

As used herein, contamination refers to a very wide range of foreign powdered materials, such as comminuted granules and the granules left behind after a change of product. The introduction of such foreign materials into polymers, in particular into high-value polycarbonates, can have a devastating influence on the end product, which are distinguished, for example, by conforming to very narrowly defined specifications with regard to optical or mechanical properties.

Figure 1:
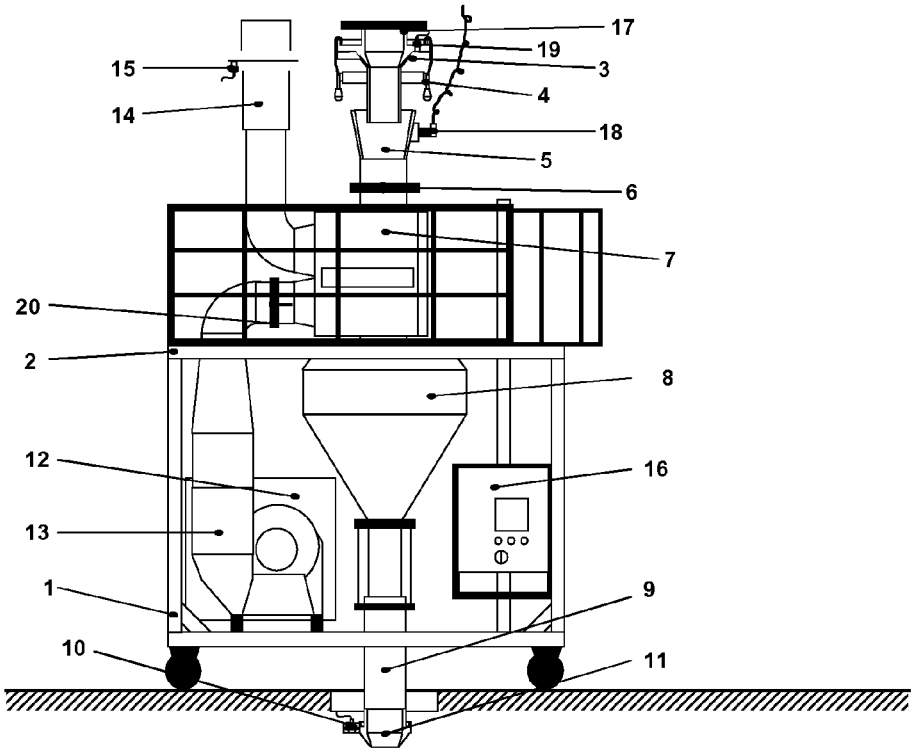
FIG. 1 is a mobile classifier in side view

The problem addressed here has been solved by providing a device, as shown in FIG. 1, comprising a classifier with an integrated working platform, possibly a fully automatic control and a stationary part of the plant substantially comprising pipelines and filter and fan systems, which includes the following features:

a base frame (1) with an integrated working platform (2) is provided with a travelling mechanism, in order to accommodate all the required components for a working dedusting process, in order thereby to set up a classification efficiently at different silo locations. The travelling frame accommodates at least the following dedusting components:

- a conical docking flange (3), free from any dead space, with quick-clamping devices (4) and an associated inlet funnel (5) with a shut-off flap (6) to the classifier
- a wind classifier, for example a gravity classifier from the company Pelletron (7)
- an intermediate container (8) as a recipient vessel
- a telescopic pipe (9) with an initiator (10) at the conical outlet flange (11)
- an intake filter (12) with a supply-air fan (13)
- an exhaust-air pipe docking means with a lifting device (14) and an initiator (15)
- possibly the local control unit (16) for regulating the rate of the air supplied and allowing the classifier to operate.

The working platform (2) with the climbing ladder serves for docking onto the silo outlet (17), for connecting the exhaust-air line (14), plugging in the coded connector (18) and also for carrying out cleaning work on the classifier.

All the valves, filters, fans and classifiers that are used can be obtained as standard on the market.

The different locations of the mobile classifier result in different routes and lengths of the lines of exhaust-air pipes to the exhaust-air fan, which calls for an adapted volumetric flow of the air exhausted by regulating the exhaust-air fan. Similarly, the volumetric flow of the air supplied must be adapted to these different lengths of extraction pipes by regulating the supply-air fan (13). Furthermore, the volumetric flows of the air supplied and the air exhausted must be regulated according to the type of product to obtain optimum classification. Automatic setting of the classifier parameters is therefore helpful for the operator.

Therefore, in a preferred embodiment, an automatic location identification on the basis of a coded E-type connector (18) is made possible for each silo, fitted from the silo outlet to the classifier inlet when docking the classifier. With the connector coding, the silo is identified and, together with a table of parameters stored in the program, the control determines the required fan parameters when the type of granules is manually preselected. In order that no product can leave the silo unintentionally, this silo location identification and the assignment of the initiators (19) at the silo outlet (17) and at the telescopic pipe outlet (10/11) are used for monitoring allowance of the classifying process with granules.

The data transfer between the local control and the higher-level central control takes place with preference via a wireless network (WLAN). This offers the additional advantage of significantly reduced cabling for the numerous locations of the mobile classifier.

With particular preference, all the component parts that come into contact with product are structurally designed to be free from dead space. As a result, cross-contamination is avoided.

With preference, the cleaning of the plant is carried out by flushing operations with water and compressed air. The basis for effective cleaning is the structural implementation of components that are free from dead space and also of flushing water outlets.

In a preferred embodiment, the flap (20) in the supply-air pipe is closed during the flushing, so that no foreign granules can be deposited there. The flap is preferably monitored in the closed state by an initiator. Only in the opened state of the flap can the classifier then be switched on. This ensures that the supply air for a functioning classifier process is present.

With preference, the drying process is carried out by dry blasting with compressed air.

For the classifier to function optimally, the amount of granules supplied may possibly be stopped by a shut-off flap (6), in order to avoid excessive rates of flow through the classifier, or possibly accumulated amounts of granules in the classifier. For example, if the rate of granules flowing out in the filling process is too low, the inflow metering to the classifier is controlled by closing the shut-off flap (6) by means of the filling-rate monitor in the recipient vessel (8). Only when there is a sufficient amount of outflow is the flap opened and the inflow to the classifier released again.

Figure 2:
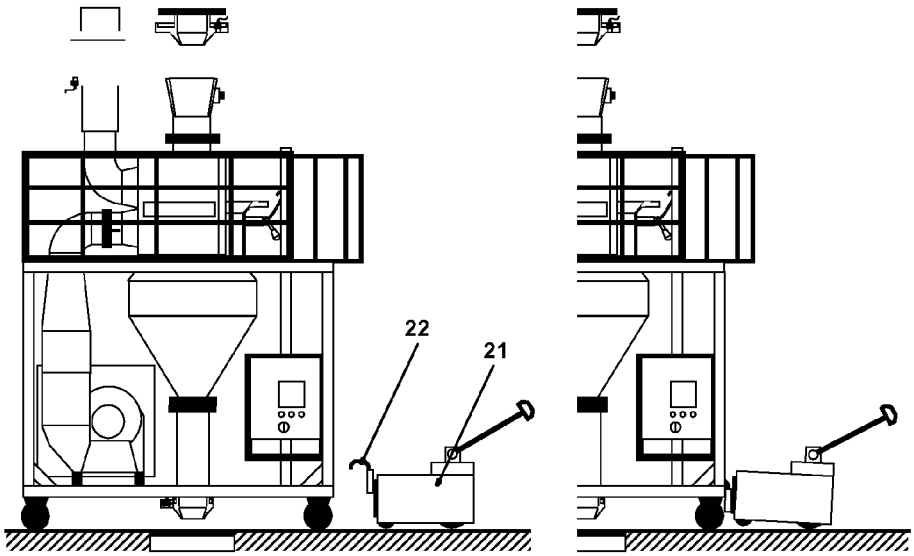
FIG. 2 shows the use of a small tractor (mover) on the mobile classifier.

Electrical drives, possibly locationally movable drives, are preferably used as an aid for moving the mobile classifier around. Locationally movable drives, i.e. drives which can be moved around independently and can be uncoupled from the material transported, have the advantage that they can be used for different transporting tasks. This so-called small tractor or mover (21) can be connected by a lifting mechanism, including two adaptation arms (22), with interlocking and frictional engagement onto the frame of the classifier. This allows the operator to accelerate, brake and steer the classifier by way of a driven steerable third wheel of the mover, as represented in FIG. 2.

Thus, an improved mobile classifier is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A device comprising a base frame (1) with an integrated working platform (2) with a traveling mechanism, the base frame accommodating at least the following dedusting components:

a. a conical docking flange (3), free from any dead space, with quick-clamping devices (4) and an associated inlet funnel (5) with a shut-off flap (6);

b. a wind classifier (7);

c. an intermediate container (8) as a recipient vessel;

d. a telescopic pipe (9) with an initiator (10) at a conical outlet flange (11);

c. an intake filter (12) with a supply-air fan (13); and f. an exhaust-air pipe docking means with a lifting device (14) and an initiator (15).

2. The device according to claim 1, wherein all component parts that come into contact with product are structurally designed to be free from dead space.

3. The device according to claim 1, wherein the working platform (2) is equipped with a climbing ladder, a device for docking onto a silo outlet (17), a device for connecting the exhaust-air line (14) and a device for plugging in a coded connector (18).

4. The device according to claim 1, further comprising a local control unit (16) for regulating the rate of the air supplied and allowing the classifier to operate.

5. The device according to claim 1, wherein an automatic location identification on the basis of a coded E-type connector (18) is performed for each silo, filled from a silo outlet to the classifier inlet when docking the classifier.

6. The device according to claim 1, wherein a data transfer between a local control and a higher-level central control takes place via a wireless network (WLAN).

7. The device according to claim 1, further comprising a lifting mechanism, including two adaptation arms (22), with interlocking and frictional engagement onto the frame of the classifier, the lifting mechanism being adapted to allow connection of a small tractor (21) to the device.

8. A method for classifying granules, comprising classifying granules using the device according to claim 1.

9. The method for classifying granules according to claim 8, wherein the amount of granules supplied is stopped by the shut-off flap (6).

10. The method for classifying granules according to claim 9, wherein a rate of granules flowing out in the filling process, inflow metering to the classifier is controlled by closing the shut-off flap (6) by means of a filling-rate monitor in the recipient vessel (8).

11. The method for cleaning a device according to claim 1, wherein a flap (20) in a supply-air pipe is closed during flushing.

12. The method for cleaning a device according to claim 11, wherein the flap (20) in the supply-air pipe is initiator-monitored.

13. The method for cleaning a device according to claim 11, further comprising drying the complete device by introducing compressed air.

* * * * *